US005833232A

United States Patent [19]

Ifkovits et al.

[11] Patent Number: 5,833,232

[45] Date of Patent: Nov. 10, 1998

[54] APPARATUS FOR ACCUMULATING AND DIRECTIONALLY REORIENTING SHEETS

[75] Inventors: Edward M. Ifkovits, New Fairfield; Karel J. Janatka, Southbury; Richard F. Stengl, Wolcott; Joseph F. Zuzick, Jr., Naugatuck, all of Conn.

[73] Assignee: Pitney Bowes Inc., Stamford, Conn.

[21] Appl. No.: 733,461

[22] Filed: Oct. 18, 1996

[51] Int. Cl.[6] ..... B65H 5/00; B65H 5/16; B65H 1/08; B65G 57/00

[52] U.S. Cl. ..... 271/225; 271/184; 271/3.01; 271/3.08; 271/9.01; 271/9.11; 271/298; 271/287; 271/296; 271/303; 270/58.2; 270/58.3; 270/58.29; 414/789.6; 414/790.9; 414/791; 414/794.7

[58] Field of Search ..... 414/789.6, 790.9, 414/791, 794.7; 271/3.08, 3.09, 3.01, 9.01, 9.11, 298, 287, 296, 297, 303, 9.02, 9.13, 184, 225; 270/58.23, 58.26, 59.29, 58.3, 58.2, 52.2, 52.26

[56] References Cited

U.S. PATENT DOCUMENTS

| | | | |
|---|---|---|---|
| 3,944,207 | 3/1976 | Bains | 271/297 |
| 4,023,670 | 5/1977 | Mathes et al. | 271/3.01 |
| 4,223,882 | 9/1980 | Stocker | 270/21 |
| 4,333,641 | 6/1982 | Peter | 271/297 |
| 4,540,458 | 9/1985 | Baughman et al. | 271/225 |
| 4,572,497 | 2/1986 | Dreschel et al. | 270/58 |
| 4,909,374 | 3/1990 | Skrypalle | 198/371 |
| 5,061,099 | 10/1991 | Iwatani et al. | 271/184 |
| 5,083,769 | 1/1992 | Young, Jr. et al. | 271/280 |
| 5,178,383 | 1/1993 | Moser et al. | 271/299 |
| 5,180,154 | 1/1993 | Malick | 271/2 |
| 5,180,159 | 1/1993 | Malick et al. | 271/302 |
| 5,188,355 | 2/1993 | Lowell et al. | 271/225 |
| 5,272,511 | 12/1993 | Conrad et al. | 271/298 |
| 5,413,326 | 5/1995 | Wright | 271/225 |

*Primary Examiner*—William E. Terrell
*Assistant Examiner*—Joe Dillon, Jr.
*Attorney, Agent, or Firm*—Christopher J. Capelli; Melvin J. Scolnick; Robert Meyer

[57] ABSTRACT

An apparatus for accumulating sheets from a secondary source and changing their conveyance direction 90°. The accumulator is a group of vertically stacked bins that discharge batchwise and are loaded from the secondary source alternately by way of a diverter. Discharge is synchronous with a directionally constant primary sheet source.

14 Claims, 10 Drawing Sheets

APPARATUS FOR ACCUMULATING AND DIRECTIONALLY REORIENTING SHEETS

BACKGROUND OF THE INVENTION

The present invention relates to the field of sheet handling, and more particularly to an apparatus for accumulating incoming sheets from one direction and reorienting the direction of feed of the sheets after a predetermined number have been accumulated.

The accumulating and directionally reorienting apparatus of the present invention is most typically used in connection with large, multi-function high speed sheet processing apparatus of the type normally found in very high volume mailing facilities, such as credit card operations, public utilities, mail order organization, corporations, magazine subscriptions, insurance companies, and a host of other organizations which must reach a large number of people, perhaps tens or even hundreds of thousands each month with different types of materials. In a typical arrangement of such an apparatus, a computer printer may print customers monthly statements of their credit card transactions for the month, which may require several pages for each customer and may therefore be printed on a web in one or two up configuration. The web is fed through a suitable slitting machine which slits it longitudinally to separate the individual sheets into two webs, and these are fed to a suitable bursting machine which separates the individual sheets laterally, so that each page of each customer's statement becomes an individual sheet. The sheets are fed to an accumulator which stacks them appropriately to form a properly organized collation for each customer. The collations are then fed to a collating machine which includes an elongate feed deck and a plurality of individual feeding devices spaced along the feed deck which add additional insert material to the collations of each customer's statement, such as advertising flyers, announcements of services, promotions, sweepstakes (more typically associated with magazine subscriptions), etc. It is not uncommon to find as many as ten or twelve such feeders mounted on a feed deck, since they may contain various types of insert material which are applicable to certain categories of customers, and appropriate software and microprocessor controls determine which feeder or feeders operate to feed what type of material to selected customers. When the collating operation is complete, all of the material is then fed to an inserting machine which inserts the collations into envelopes, which are then fed to a mailing machine which closes and seals the flaps of the envelopes and prints postage indicia thereon, after which the envelopes are fed to suitable stacking machines for delivery to a postal facility. It should be understood that there are many varieties of the apparatus described above, and certain operations described may be omitted or others included, depending on the nature of the mailing operation.

It should be apparent that apparatus as described above is highly complex and expensive, and therefore must produce a high volume through put rate, and operate with a high degree of reliability to maintain continuity of operation at that through put, in order for the mailer to be able to justify the cost of acquiring and maintaining the equipment. There are two principal factors that contribute to these requirements, one being speed of operation, the other being flexibility to interchange various types of operations with a minimum number of different types of apparatus. The present invention concerns the second of these factors.

One problem that arises from time to time in connection with the operation of apparatus as above described is that a certain type of insert material must be included with the final collation that is inserted into an envelope and mailed to a customer that cannot be processed by the normal components found in a typical sheet processing apparatus as above described. For example, it is occasionally necessary to include a plurality of computer printed forms, sheets, etc., in a single collation, such as a quarterly customer insurance premium statement and a personalized solicitation for the customer to buy additional insurance. Since neither of these can be pre-printed and placed in one of the feeders along the collating machine deck, they must be processed in the same manner, i.e., slit, burst, accumulated and fed to the collating machine. Thus, duplicate equipment is required that further adds to the expense of obtaining and maintaining the processing equipment. Another example is the situation where one item of the insert material is a bound booklet, which typically cannot be stacked in the type of feeders normally used with the collating machines. Still further, it is sometimes desirable to associate a plurality of collations together before further insert material is added by the collating machine, and again this cannot be done with available equipment.

One solution to these problems is to provide what is known as a right angle turner, which is a machine that is inserted into the mainstream setup of the type of processing apparatus described above, and which receives material from one of a variety of sheet input machines in a direction normal to the direction of feed of material traveling along the mainstream feed path. The right angle turner receives a sheet or sheet from the input machine in the lateral direction, stops its movement, and then feeds it out in the longitudinal direction of the mainstream feed path, so that it can be appropriately associated with the incoming material in the mainstream feed path in an accumulator. Various types of these machine are known in the art, but with certain deficiencies that fail to solve the foregoing problems in a satisfactory manner.

Thus, it is apparent that there is a need for an apparatus for accumulating and directionally reorienting sheets being fed along a feed path that can effectively accumulate a plurality of sheets, booklets, or the like, and reorient the direction of continued feed of the sheets or booklets, and do so with a maximum through put rate that can meed if not exceed the throughput rate of the primary mainstream feeding means for sheets being fed through the mainstream.

BRIEF SUMMARY OF THE INVENTION

The present invention substantially obviates if not entirely eliminates the foregoing disadvantages and drawbacks of prior art sheet turning devices by providing an apparatus which effectively fulfills the foregoing need.

A basic principle of the present invention is to provide an apparatus for accumulating and directionally reorienting sheets that has a through put rate that exceeds the through put rate of the mainstream feeding and processing components of the overall processing apparatus with which the apparatus of the present invention is used. This is accomplished by substantially increasing the sheet handling capacity of the accumulating and directionally reorienting apparatus so that it can process sheets at a rate substantially greater than that at which sheets are processed by the mainstream feed and accumulating apparatus while operating at substantially the normal rate of speed as is customary with similar reorienting apparatus.

Thus, in its broader aspects, the principles of the present invention are embodied in an apparatus for accumulating and directionally reorienting the movement of sheets being fed from a supplemental source along a supplemental sheet feed path defined by a supplemental sheet feeding means into a primary sheet feed path defined by a primary sheet feeding means which feeds sheets from a primary source. In this environment, the accumulating and directionally reorienting apparatus comprises means defining a plurality of vertically stacked sheet collecting bins disposed in overlying relationship to the primary sheet feed path, each of the bins having an inlet opening extending along one side thereof that is perpendicular to the direction of the supplemental sheet feed path for receiving sheets from the supplemental source along the supplemental sheet feed path, and a discharge opening on another side thereof that is disposed perpendicular to the one side for discharging sheets into the primary sheet feed path. A sheet directing means is mounted adjacent the inlet openings of the bins for directing sheets successively into the plurality of bins. An ejecting means is disposed in each of the bins for ejecting sheets therefrom successively through the discharge openings. There is a control means for operating the sheet directing means and the ejecting means in a predetermined timed sequence to permit a predetermined number of sheets to enter each of the bins and to cause the ejecting means to eject the accumulated sheets from the bins successively when the predetermined number of sheets has been fed to the bins, so that the sheets from the supplemental source can be associated with sheets from the primary source at a location disposed downstream from the accumulating and directionally reorienting apparatus.

In some of its more limited aspects, the plurality of bins, in the preferred embodiment, is limited to two, and the sheet directing means is a deflector means that oscillates between two positions to direct sheets alternately into an upper and a lower bin. The ejector means comprises a pusher element mounted in each of the bins, with a drive mechanism that operates the pusher elements in an asynchronous manner so that when one pusher element is moving in the direction for ejecting sheets, the other pusher element is simultaneously moving in a retracting direction. The bins are pivotally mounted so that they can be raised to a vertical position for clearing jams in the bins and in the primary sheet feeding means beneath the bottom bin.

Having briefly described the general nature of the present invention, it is a principal object thereof to provide an improved apparatus for accumulating and directionally reorienting the movement of sheets from a supplemental source being fed along a supplemental feed path to a primary feed path to become associated with sheets moving therealong.

It is another object of the present invention to provide an apparatus as described that will handle sheets from the supplemental source at a substantially greater through put rate than that at which they are fed from the primary source so that multiple sheets can be associated with individual sheets from the primary source.

It is still another object of the present invention to provide an apparatus as described that can receive individual sheets or bound booklets, and form collations of either, in a plurality of bins, so as to maximize the through put rate of the accumulating and directionally reorienting apparatus.

These and other objects and features of the present invention will become more apparent from an understanding of the following detailed description of a presently preferred embodiment of the invention, when considered in conjunction with the accompanying drawings.

DETAILED DESCRIPTION OF THE INVENTION

Figure 1:
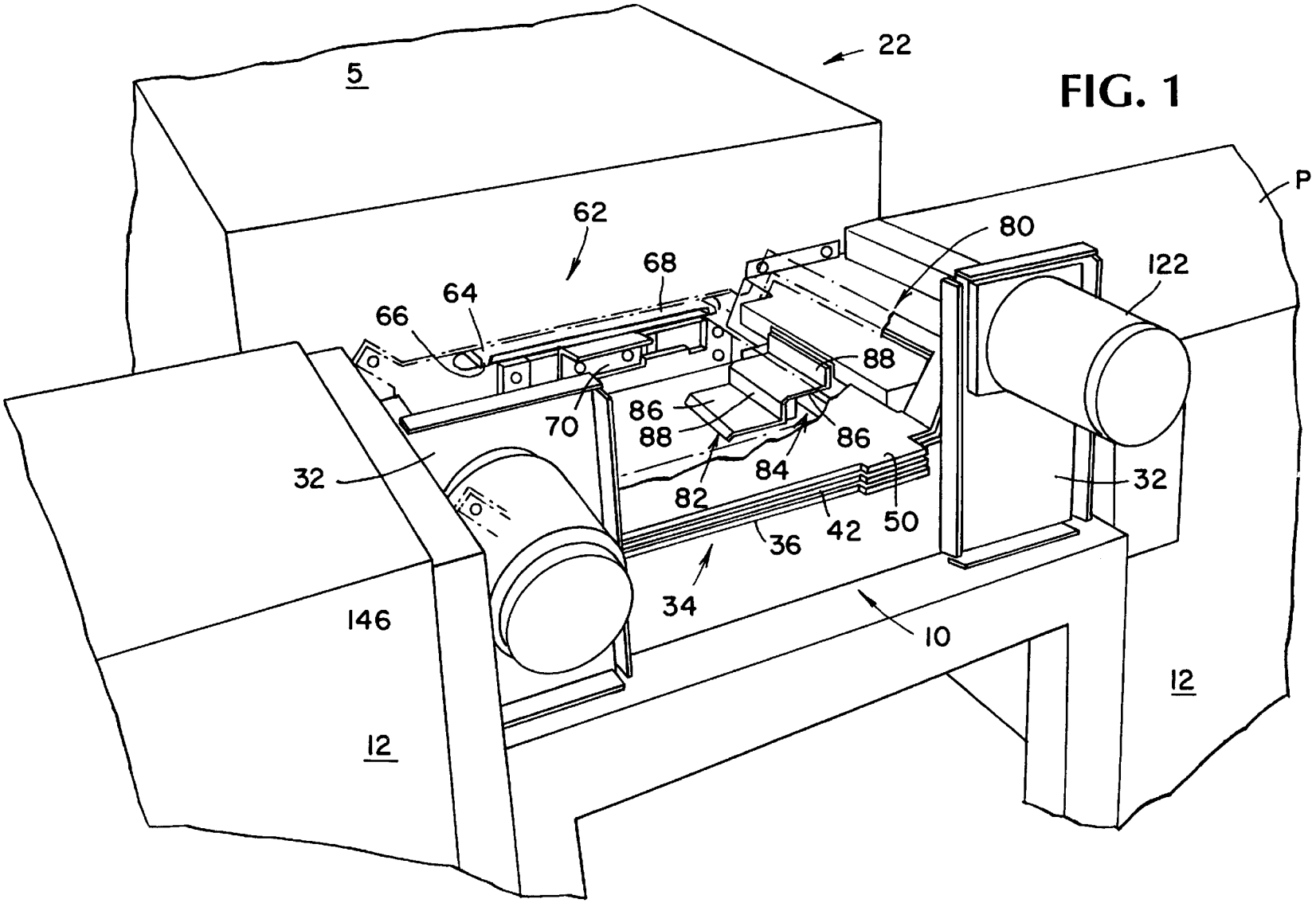
FIG. 1 is a perspective view of the accumulating and directionally reorienting apparatus of the present invention.

Referring now to the drawings, and particularly to FIG. 1 thereof, the reference numeral 10 indicates generally an apparatus for accumulating and directionally reorienting the movement of sheets according to the principles of the present invention. The apparatus 10 is intended to receive sheets, either seriatim or in preformed bound booklet configuration, from a supplemental source along a supplemental sheet feed path defined by a supplemental sheet feeding module, and to accumulate a predetermined plurality of the sheets or booklets and reorient the direction of movement thereof into a primary sheet feed path defined by a primary sheet feeding device which feeds from a primary source, so that the accumulated sheets or booklets within the apparatus 10 can be appropriate joined with the sheets being fed along the primary path.

Figure 5:
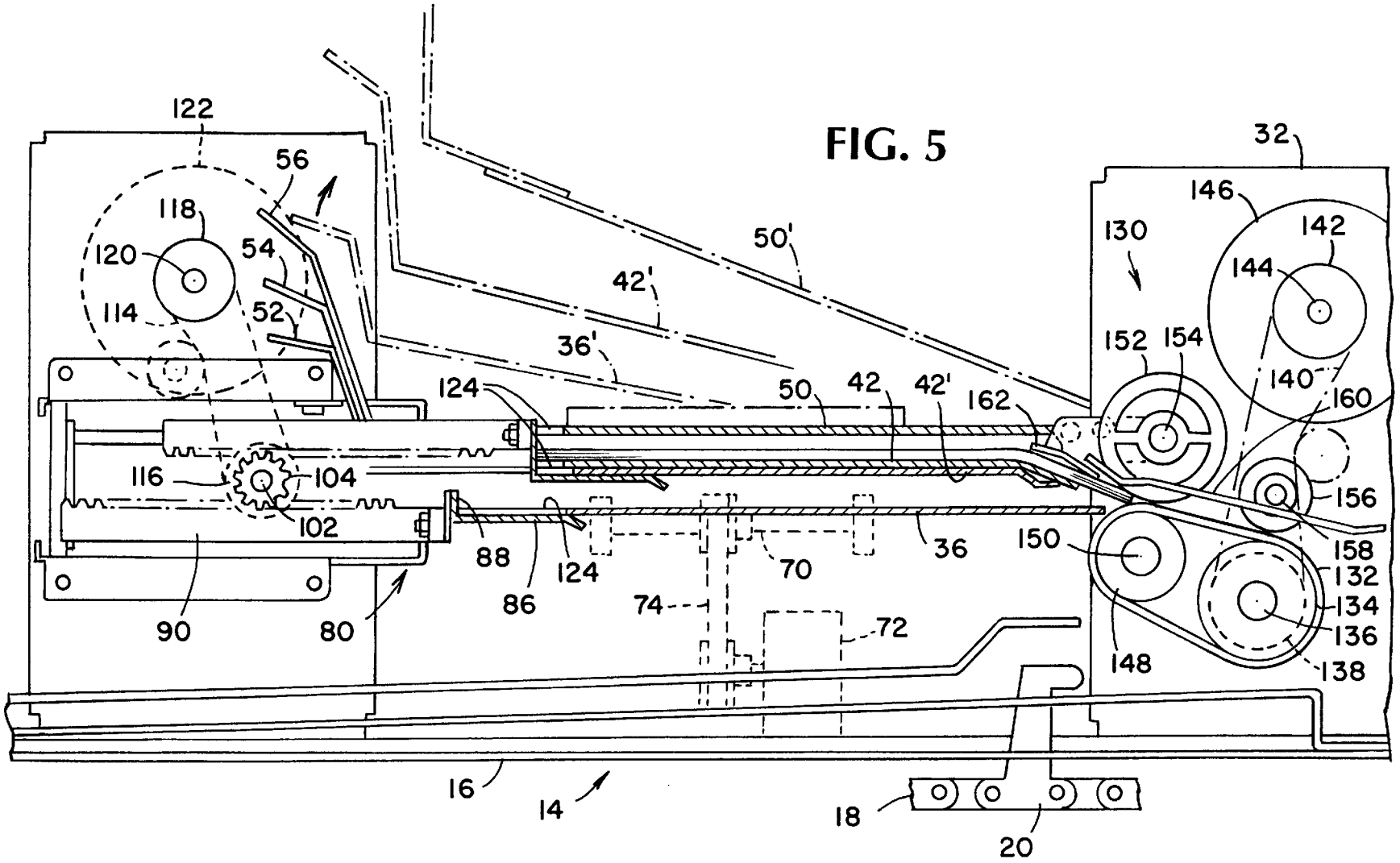
FIG. 5 is a longitudinal sectional view taken on the line 5—5 of FIG. 2 showing an accumulation of sheets being discharged from the upper bin, and also showing in phaeton lines the manner in which the bin elements can be raised for clearing jams.
Figure 6:
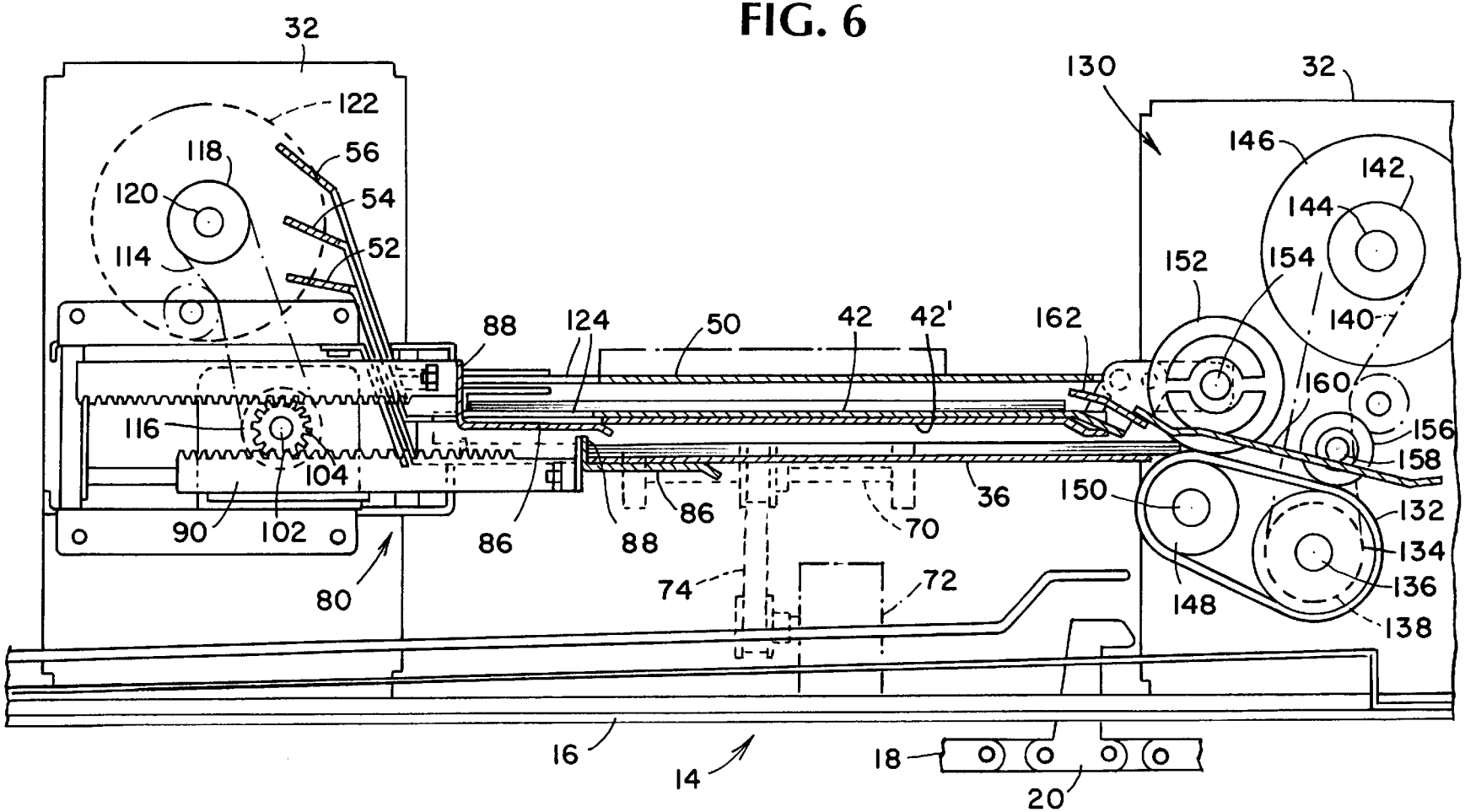
FIG. 6 is a view similar to FIG. 5 but showing an accumulating of sheets being discharged from the lower bin.

Thus, the apparatus 10 is typically incorporated into a multi-function high speed sheet processing apparatus, indicated generally by the reference numeral 12, of the type briefly described above. This apparatus feeds sheets from a primary source, indicated by the reference letter P, along a primary sheet feed path defined by a primary sheet feeding means, indicated generally by the reference numeral 14 in FIG. 5, and which includes any suitable type of elongate frame 16 capable of supporting a drive chain 18 on which a plurality of pushers 20 are mounted. The pushers 20 move sheets, again individually or in collation form, from the primary source P in a right to left direction as viewed in FIG. 1 underneath the apparatus 10, as seen in FIGS. 5 and 6 but in which the direction of movement of the sheets from the primary source P is reversed. The apparatus 12 forms no part of the present invention and therefore is not further shown or described herein except to any further extent necessary for an understanding of the apparatus 10.

The apparatus 10 receives sheets or booklets, as described above, from any suitable feeder input module, indicated generally by the reference numeral 22, which also forms no part of the present invention and therefore is also shown and described only to the extent necessary for an understanding of the apparatus 10. The feeder input module receives sheet or booklets from a supplemental source thereof, indicated by the reference letter S, and feeds them along a supplemental feed path defined by a supplemental feeding means, indicated generally by the reference numeral 24 in FIG. 3, only the terminal portion thereof being shown. Thus, a suitable deck 26 supports the incoming sheets or booklets, and a plurality of cooperating feed rollers assemblies 28 and backup pressure roller assemblies 30 move the sheets or booklets along the deck 26 toward the apparatus 10 to be fed into accumulating bins yet to be described. The structure thus far described is intended merely to orient the apparatus 10 into a typical operational environment.

Figure 2:
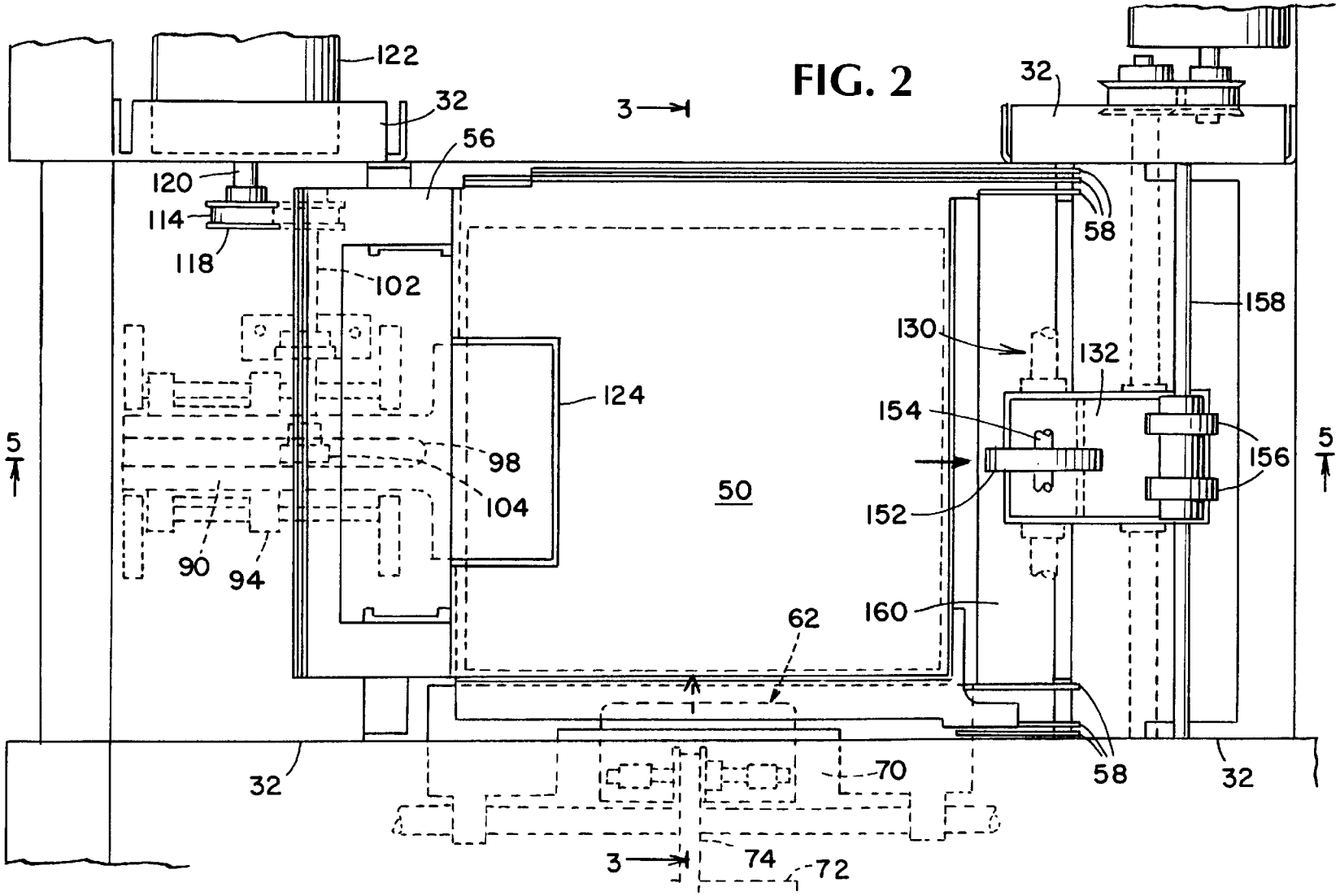
FIG. 2 is a plan view of the apparatus shown in FIG. 1.
Figure 3:
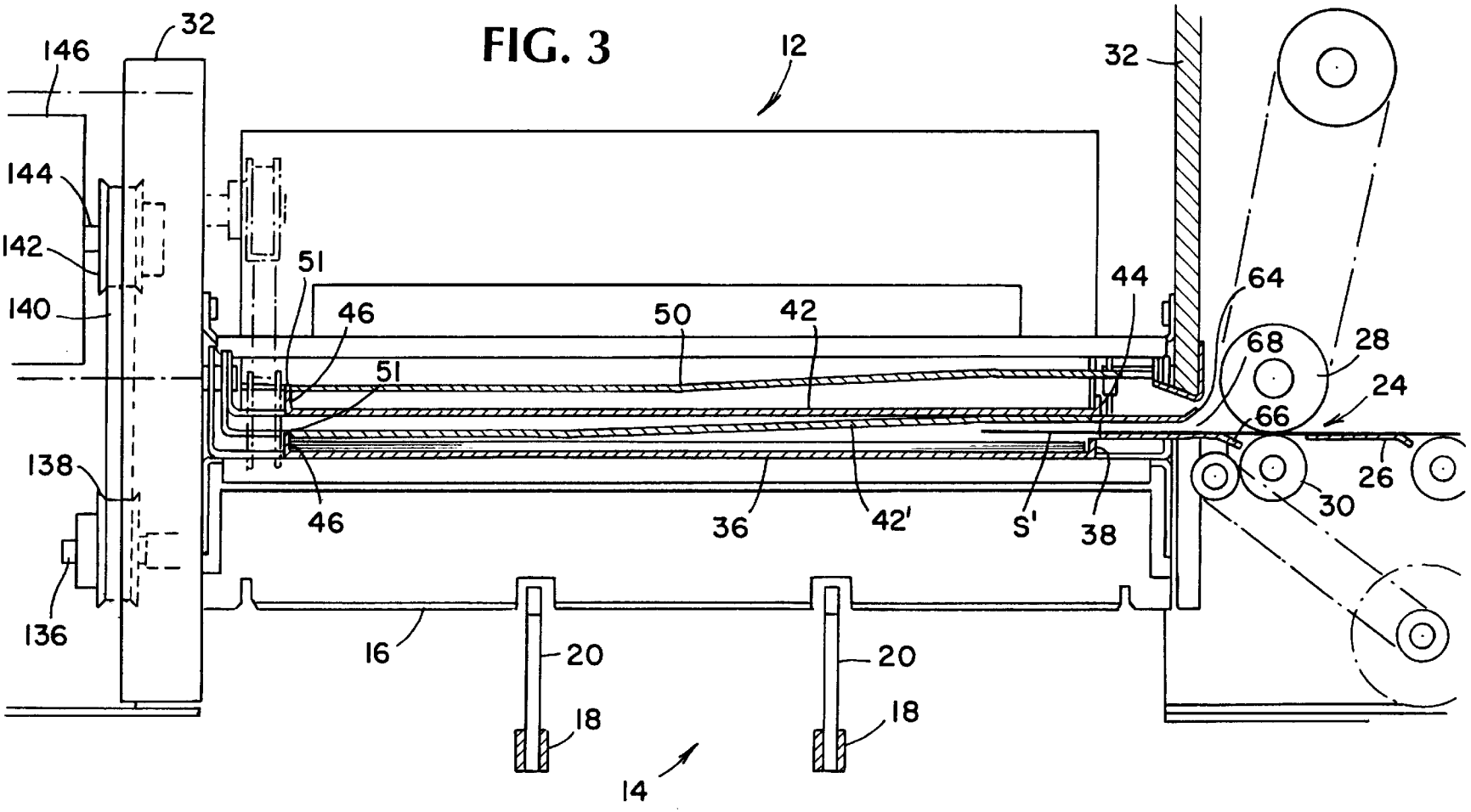
FIG. 3 is a lateral sectional view taken on the line 3—3 of FIG. 2 showing a sheet being fed into the lower bin from the supplementary source.

The accumulating and directionally reorienting apparatus 10 comprises a plurality suitable frame members 32, of which only a portion is shown in the drawings, but which supports in suitable manner, the parts and components hereinafter described. The apparatus includes a plurality of vertically stacked bins, indicated generally in FIG. 1 by the reference numeral 34, which in the preferred embodiment is two bins, and which are defined by a plurality of substantially flat, generally rectangular sheets arranged one on tip of another. Thus, as best seen in FIGS. 2 and 3, a bottom plate 36 defines a lower bin and is supported by the frame members 32 so as to lie in a substantially horizontal plane, the plate 36 including an elongate upstanding flange 38 extending along the side of the plate 36 that is adjacent to the discharge end of the supplemental feeding means 24, and another elongate upstanding flange 40 extending along the opposite side of the plate 36. As will be seen in more detail below in connection with the description of the operation of the apparatus 10, the flange 40 functions as a stop and registration wall for incoming sheets, the flange 38 prevents sheets striking the wall 40 from bouncing back out of the bin defined by the bottom plate 36.

An intermediate plate 42, which defines an upper bin, is similarly supported by the frame members 32 so as to lie in a substantially horizontal plane in vertically spaced relationship with the bottom plate 36. The plate 42 also includes an elongate upstanding flange 44 extending along the side of the plate 42 that is adjacent to the discharge end of the supplemental feeding means 24, and another elongate upstanding flange 46 extending along the opposite side of the plate 42. The flanges 44 and 46 on the plate 42 perform the same functions as the corresponding flanges 38 and 40 on the bottom plate 36. The intermediate plate 42 is comprise of two layers, the upper layer designated 42 which forms the upper bin, and a lower layer designated 42' which is connected to the upper layer 42 and is angled downwardly into the lower bin defined by the bottom plate 36 so as to form a slated cover for the lower bin, the underside of which directs incoming sheets downwardly so that they will stack properly in the bin.

A top-plate 50 is supported on the side frame members 32 so as to also lie in a substantially horizontal plane and in vertically spaced relationship with the intermediate plate 42. The top plate 50 constitutes a cover for the upper bin, and is angled downwardly into the upper bin so as to function in this bin in the same manner as the cover 42' for the lower bin.

The bottom layer 42' of the intermediate plate 42 and the top plate 50 are both provided with elongate grooves 51 which correspond in location and length to the flanges 40 and 46 of the bottom plate 36 and intermediate plate 42, so that the upper edges of the flanges 40 and 46 are disposed within these grooves 51 when the plates 36, 42 and 50 are in their normal operating positions as shown in FIG. 3, thereby preventing any incoming sheets from passing over the top of the flanges 40 and 46.

As best seen in FIGS. 1, 5 and 6, the plates 36, 42 and 50 can be raised to a vertical position to permit jams to be cleared from the upper bin, the lower bin or the primary feeding means 14 where it passes beneath the apparatus 10. Thus, each of the plates 36, 42 and 50 have upwardly and rearwardly extending handle portions 52, 54 and 56 for the plates 36, 42 and 50 respectively. Also, each of the plates 36, 42 and 50 have a pair of forwardly projecting tabs labeled 58 for all of the sheets (best seen in FIG. 2) by which the plates 36, 42 and 50 are pivotally mounted on a pair of stub shafts 60 suitably mounted in the side frames 32. With this arrangement, it is possible to lift each of the plates 36, 42 and 50 individually by grasping the handles 52, 54 and 56 and raising the sheets, as indicated by the numerals 36', 42' and 50' in FIG. 5.

The space between the bottom plate 36 and the intermediate plate 42 adjacent the discharge end of the supplemental feeding means 24 constitutes an inlet opening into the lower bin. Similarly, the space between the intermediate sheet 24 and the top plate 50 at the same location constitute an inlet opening into the upper bin. Also, similar spaces between these same plates adjacent the sides thereof that are perpendicular to the inlet openings define discharge openings from the upper and lower bins.

Figure 4:
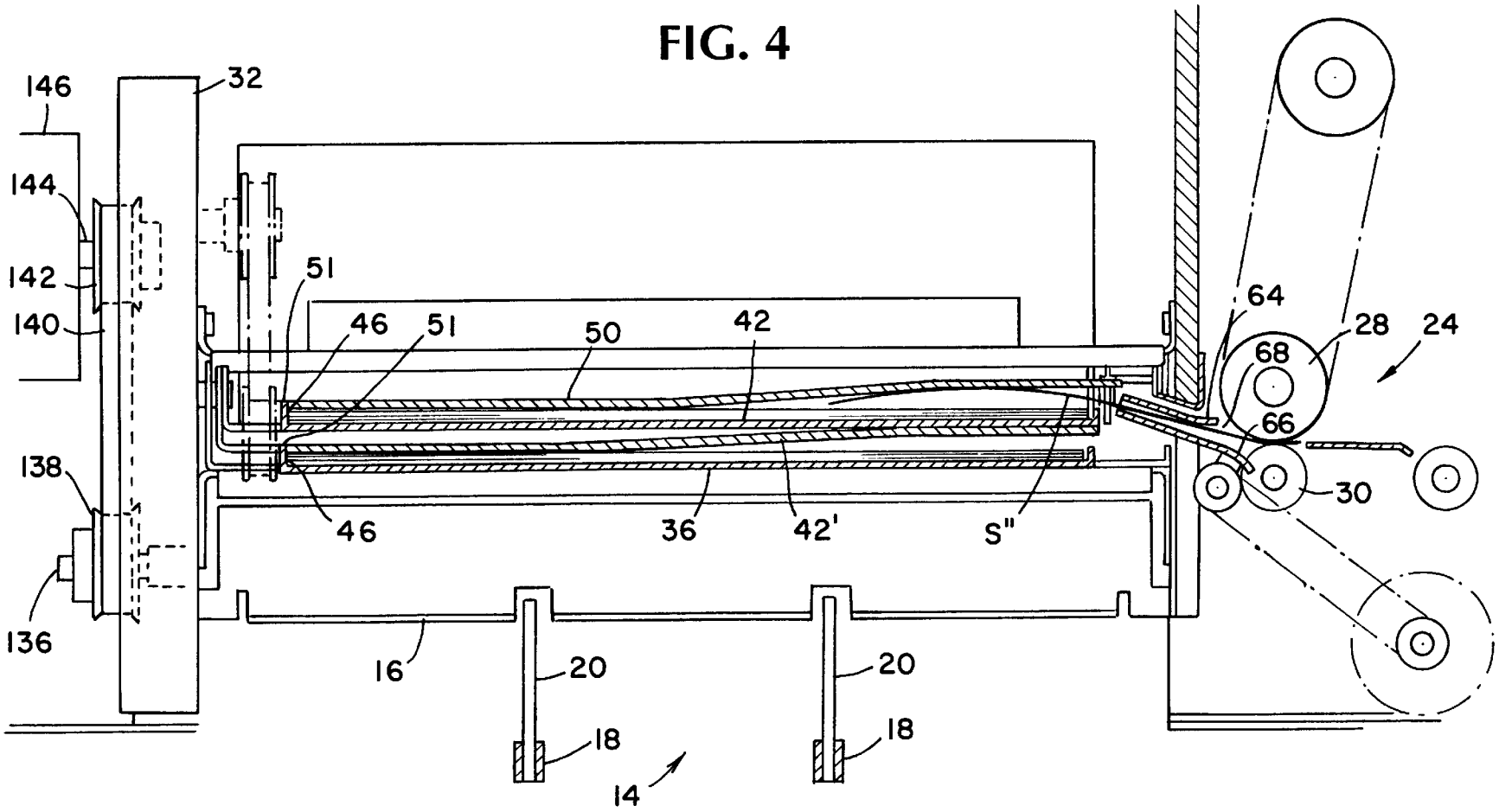
FIG. 4 is a view similar to FIG. 3 but showing a sheet being fed into the upper bin from the same source.

Referring now to FIGS. 1, 3 and 4, the apparatus 10 is provided with sheet directing means, indicated generally by the reference numeral 62 in FIG. 1, for directing sheets being discharged by the supplemental feeding means 24 into either the lower bin or the upper bin, or into any selected bin in the event that the apparatus 10 is constructed to have more than two bins. In the embodiment shown, the sheet directing means 62 comprises a pair of upper and lower plates 64 and 66 respectively, which are suitably connected together to form a unitary assembly having a chute 68 extending between the plates 64 and 66. The unitary assembly of the plates 64 and 66 includes a suitable frame 70 (FIGS. 1, 5 and 6) that is suitably pivotally mounted on a portion of one of the frame members 32 so that the assembly of the plates 64 and 66 defining the chute 68 can be pivoted from a horizontal position shown in FIG. 3 to an upwardly directed position shown in FIG. 4. Thus, it will be apparent that when the chute 68 is in the position shown in FIG. 3, an incoming sheet S' will be directed into the lower bin and be deposited on the bottom plate 36, and when the chute 68 is in the position shown in FIG. 4, an incoming sheet S" will be directed into the upper bin and be deposited on the intermediate plate 42. The frame 70 is alternately oscillated between the positions shown in FIGS. 3 and 4 respectively by any suitable means, such as the rotary solenoid 72 which is connected to the frame 70 by means of a belt 74.

The apparatus 10 further includes an ejecting means disposed in each of the bins for ejecting the sheets therefrom through discharge openings from the bins and into a take away feeding mechanism for transfer to the primary sheet feeding means 14. Thus, with reference now to FIGS. 1 and 5 through 8, the ejecting means, indicated generally by the reference numeral 80, comprises a pair of pusher elements, in the case of the preferred embodiment of two bins, a pusher element generally designated 82 in the lower bin and another pusher element generally designated 84 in the upper bin. Each pusher element is L-shaped, with a bottom leg 86 and a vertical rear leg 88, the bottom let supporting the rear edge portions of the collations of sheets during the ejection movement, and the legs 88 serving to push the collations out of the bin, as seen in more detail hereinafter.

Figure 7:
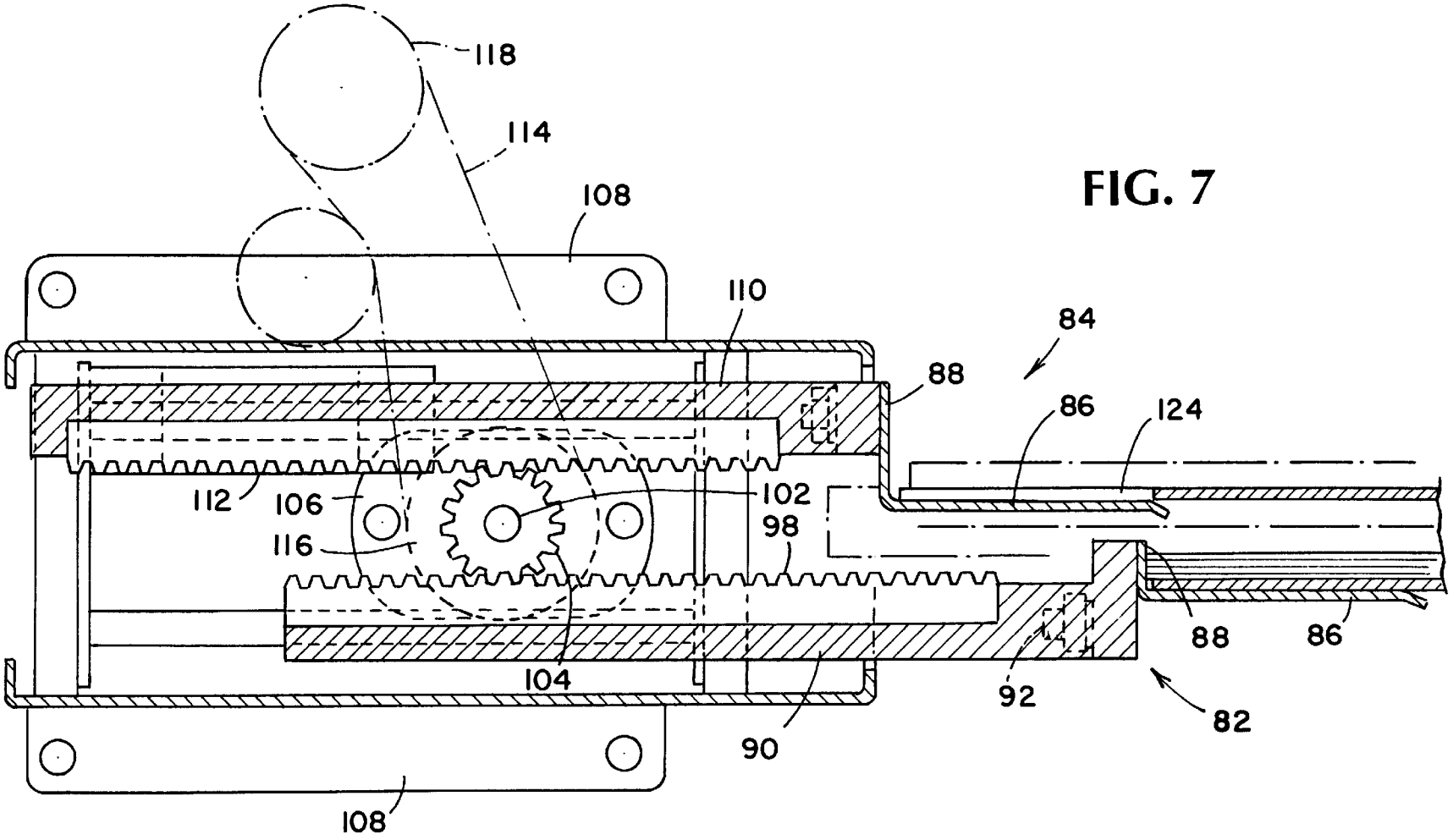
FIG. 7 is a fragmentary view, drawn to an enlarged scale, of the drive mechanism for the pusher members that eject sheets from the bins.
Figure 8:
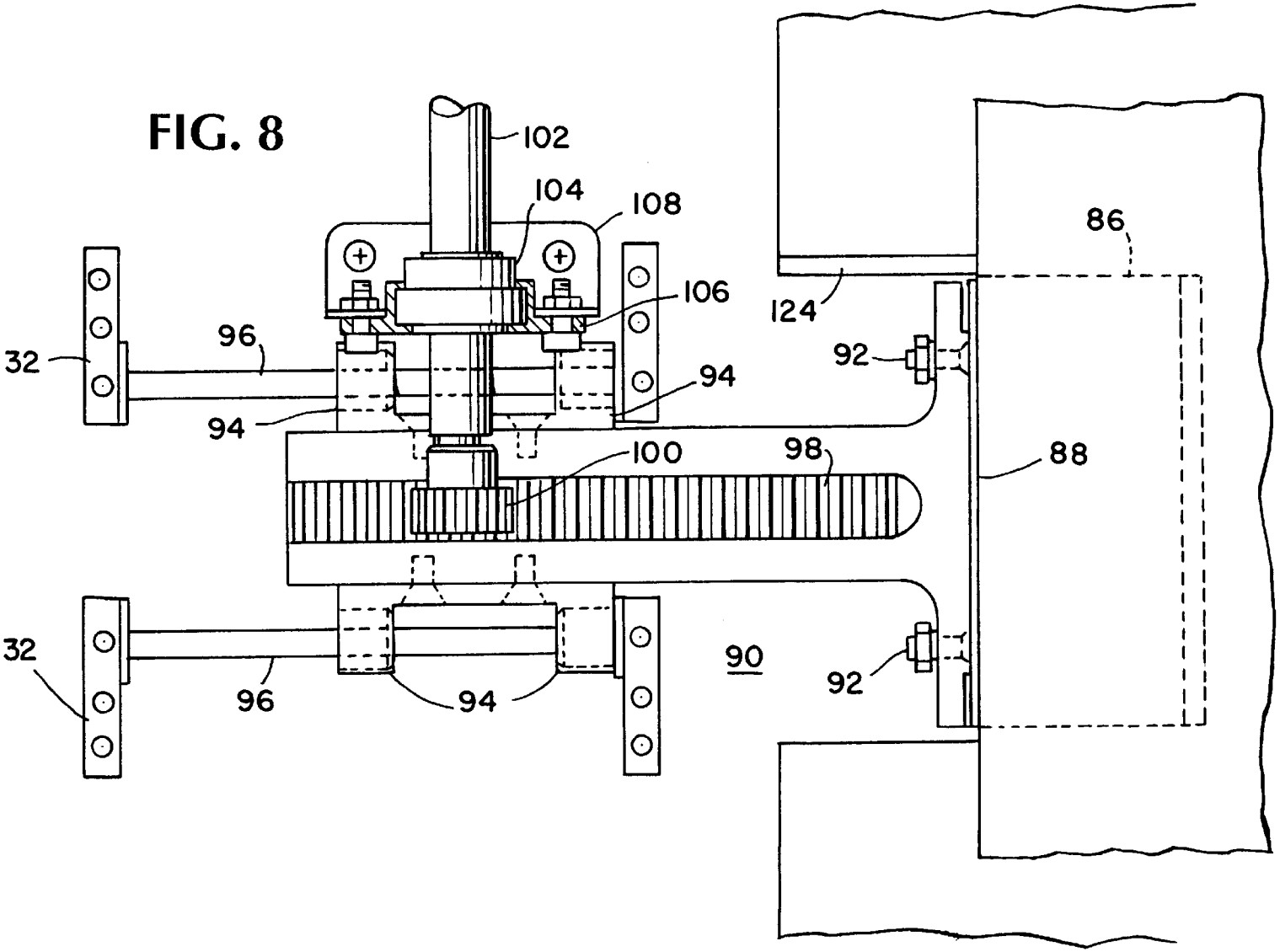
FIG. 8 is a fragmentary plan view of a portion of the drive mechanism shown in FIG. 7.

As best seen in FIGS. 7 and 8, the lower pusher element 82 is suitably connected to the forward end an elongate bar 90 as by the screws 92, and the bar 90 is provided with laterally extending wings 94 by which the bar 90 is slidably mounted on a pair of rods 96 which are suitably connected to a portion of the frame members 32. The bar 90 includes a rack 98 extending along a major portion of the length thereof, which is engaged by a pinion 100 mounted on the free end of a shaft 102. The shaft 102 is rotatably mounted in a bearing member 104 suitably connected to a bracket 106 which in turn is connected to another bracket 108 which further in turn is connected to a portion a frame member 32. It will be apparent that rotation of the pinion 100 in either direction will move the rack 98 and the bar 90 either forwardly or rearwardly, i.e., from left to right as viewed in FIG. 8, or vice versa.

Although not shown in full detail, the upper pusher element 84 is connected to another bar 110, which is a duplicate of the bar 90, which is supported for reciprocatory movement in the same manner as the lower bar 90. The bar 110 is also provided with a rack 112 which is in engagement with the pinion 104. As seen in FIG. 7, the parts are assembled such that opposite ends of the racks 98 and 112 are in engagement with the pinion 104 when the pusher elements 82 and 84 are in their full extended and retracted positions, so that rotation of the pinion in a clockwise direction as viewed in FIG. 8 will move the lower pusher element 82 rearwardly and simultaneously move the upper pusher element 84 forwardly. The shaft 102 is suitably drive by a belt 114 connected to a pulley 116 on the shaft 102 which in turn is driven by a pulley 118 mounted on the drive shaft 120 of a motor 122 (FIG. 1). The direction of rotation of the shaft 102 and the pinion 104 is controlled by the direction of rotation of the drive shaft of the motor 118.

It will be seen that each of the plates 36, 42 and 50 is provided with a generally rectangular cut out designated 124 for each plate along the rear portion of each plate adjacent the pusher elements 82 and 84, of which all three can seen in FIGS. 5 and 6, which accommodate the vertical leg 88 of each pusher element 82 and 84 during forward movement thereof.

As best seen in FIGS. 2, 5 and 6, the apparatus 10 is provided with a take away feeding means, indicated generally by the reference numeral 130. It should be understood that the take away feeding means 130 shown and described is merely illustrative of a typical take away feeding means which can be used with the apparatus 10 of the present invention, and other suitable take away feeding mechanisms could be used. Thus, it will be seen that the take away feeding means 130 comprises a feed belt 132 which passes around a pulley 134 mounted on a shaft 136 suitably mounted between side frame members 32, and which is driven by another pulley 138 which in turn is driven by a belt 140 and another pulley 142 mounted on the end of the drive shaft 144 of a motor 146 mounted on the frame member 32. The feed belt 132 also passes around a roller 148 mounted on a shaft 150 suitably mounted on the frame members 32. A backup roller 152 is mounted on a shaft 154 which is also suitably mounted on the frame members 32 so as to form a nip with the outer surface of the belt 132 substantially over the shaft 150. A pair of back up rollers 156 are mounted on a shaft 158 suitably mounted on the frame members 32 so as to form a nip with the outer surface of the belt 132 substantially over the shaft 136. A laterally elongate guide plate 160 is mounted over the feed belt 132 to ensure that sheets passing over the feed belt 132 are guided into the two nips formed by the belt 132 and the back up rollers 152 and 156. A short baffle plate 162 is suitably mounted adjacent the discharge end of the upper bin to direct sheets being discharged from the upper bin beneath the rearward portion of the guide plate 160.

Figure 9:
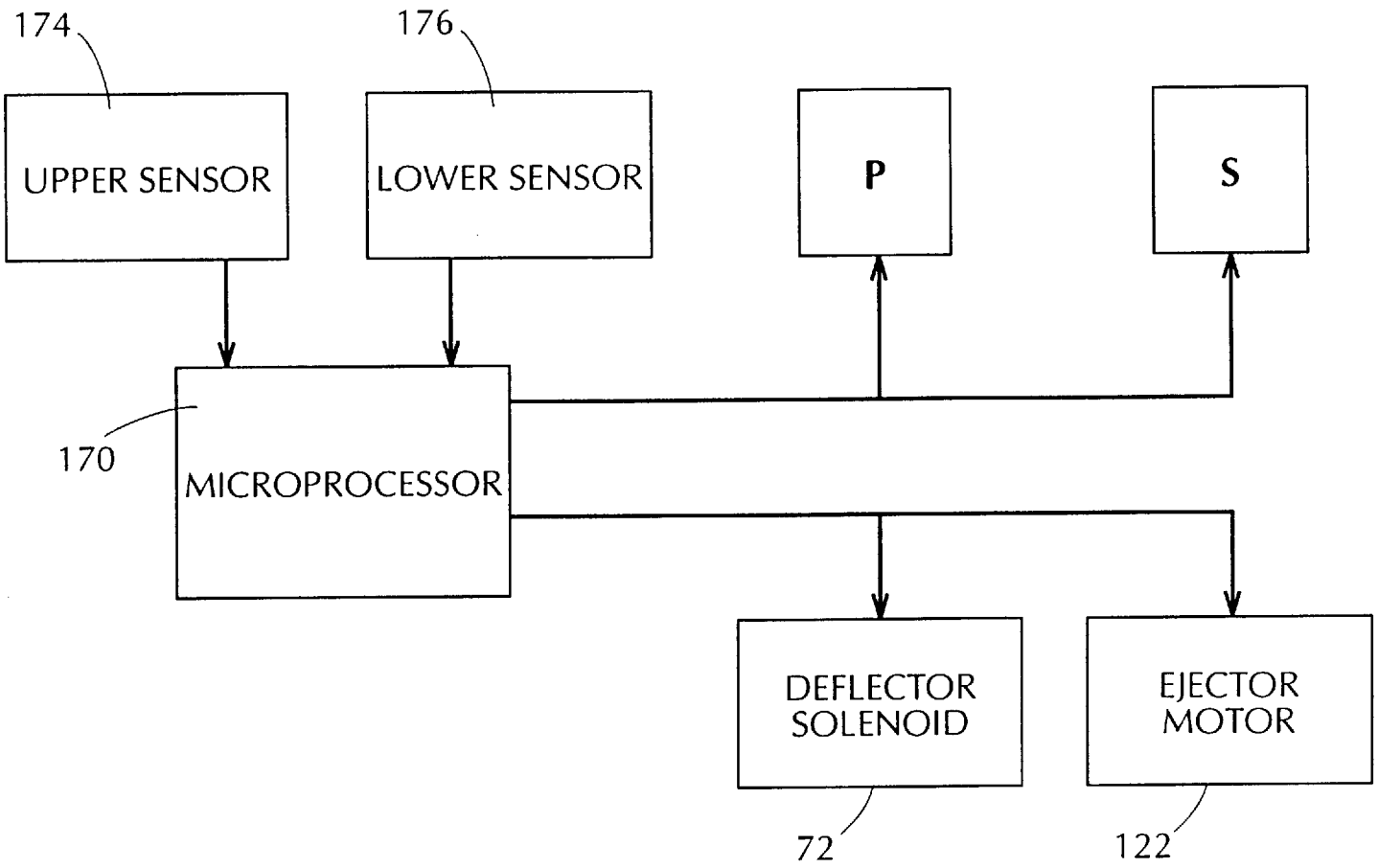
FIG. 9 is a schematic diagram of the major operating control components of the apparatus of the invention.
Figure 10:
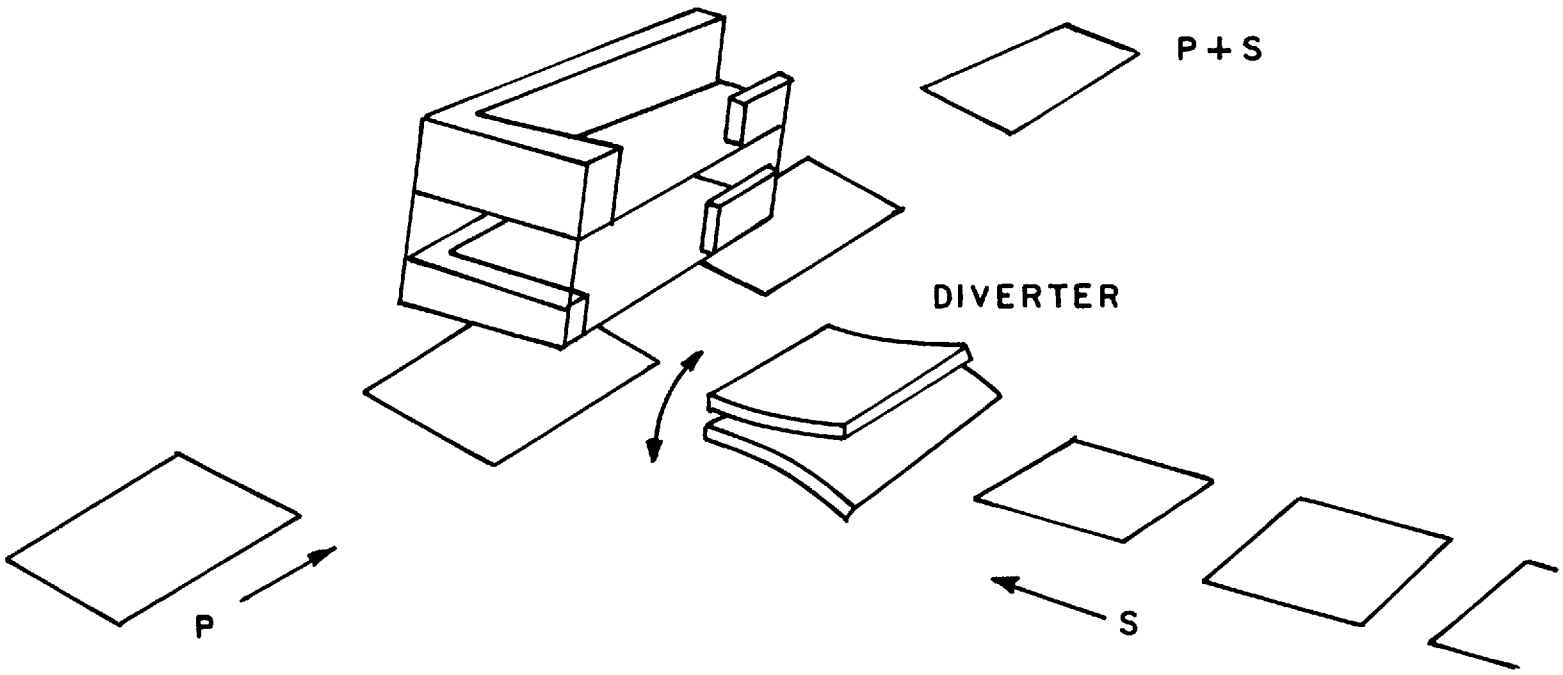
FIG. 10 is an abstraction of the essential operational features.

FIG. 9 is a simplified schematic diagram of the essential components of the control system for controlling the operation of the sheet directing means 62 to permit a predetermined number of sheets or booklets, as the case may be, to enter each of the bins, and for controlling the operation of the ejecting means 80 in a predetermined timed sequence with operation of the sheet directing means 62 to cause accumulated sheets or booklets to be discharged for association with sheets being fed by the primary feeding means 14 to a downstream accumulation location. Thus, the apparatus 10 of the present invention is under the control of a microprocessor 170 which controls the operation of the all of the components which make up the sheet processing apparatus 12, regardless of the specific configuration thereof. The microprocessor 170 includes appropriate software which controls the feeding of sheets from the primary source P by the primary sheet feeding means 14, and also controls the timing of the feeding of supplemental sheets or booklets from the supplemental source S to the input feeder module 12.

Thus, a complete cycle of operation of the apparatus 10 can now be described with reference to FIG. 9 and other figures as indicated. The cycle of operation will be explained commencing with the parts of the apparatus 10 in the positions shown in FIGS. 3 and 5, in which the sheet directing means 62 is directing sheets into the lower bin as in FIG. 3 and the sheet ejecting means 80 of the upper bin is ejecting sheets therefrom as in FIG. 5. As sheets or booklets, as the case may be, are fed from the supplemental feeding means 24 through the chute 68 of the sheet directing means 62, they accumulate in the lower bin, and a suitable sensing device 174 suitably mounted in the lower bin determines when the predetermined number of sheets as determined by software in the microprocessor has arrived in the bin.

While the sheets from the supplemental source S are accumulating in the lower bin, the collation of sheets in the upper bin is being withdrawn therefrom by the take away feeding device 130, as shown in FIG. 5, in a manner described below.

When the predetermined number of sheets has accumulated in the lower bin, the sensor 174 sends a signal to the microprocessor 170 that this has been accomplished. The microprocessor 170 then sends a signal to the motor 122 to cause the pinion to rotate in a counterclockwise direction so as to cause the lower pusher element 82 to move from the position shown in FIG. 5 to the position shown in FIG. 6, thereby advancing the leading edge of the collation in the lower bin into the nip between the feed belt and the back up roller 152, so that the collation is withdrawn from the lower bin. During this forward movement of the lower pusher element 82, the upper pusher element 84 is moving rearwardly out of the path of incoming sheets. When the pusher elements 82 and 84 have reached their extreme forward and rearward positions respectively, the microprocessor sends a signal to the solenoid 72 to change the position of the sheet directing means 62 so that sheets are now directed into the upper bin, as shown in FIG. 4. Another sensing device 176 is suitably mounted in the upper bin to determine when the predetermined number of sheets has entered that bin, and when that occurs, the same sequence of events occurs again to simultaneously energize the motor 122 to rotate the pinion 104 in a clockwise direction to cause the upper pusher element 86 to move the collation in the upper bin forwardly, as seen in FIG. 5, until the leading edge of the collation has been engaged by the nip of the feed belt 132 and the back up roller 152 to be withdrawn from the bin. Also, when the pusher element 82 for the lower bin reaches its extreme rearward position, the microprocessor 170 sends a signal to the solenoid 72 to change the position of the sheet directing means 62 back to that shown in FIG. 3, so that sheets are again directed into the lower bin, thereby completing a cycle of operation of the apparatus 10.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. An apparatus for accumulating and directionally reorienting the movement of sheets being fed from a supplemental source along a supplemental sheet feed path defined by a supplemental sheet feeding means into a primary sheet feed path defined by a primary sheet feeding means which feeds sheets from a primary source, said accumulating and directionally reorienting apparatus comprising:

A. means defining a plurality of vertically stacked sheet collecting bins disposed in overlying relationship to said primary sheet feed path, each of said bins having
   1. an inlet opening extending along one side thereof that is perpendicular to the direction of said supplemental sheet feed path for receiving sheets from said supplemental source along said supplemental sheet feed path, and
   2. a discharge opening on another side thereof that is disposed perpendicular to said one side for discharging sheets into said primary sheet feed path, B. sheet directing means mounted adjacent said inlet openings of said bins for directing sheets successively into said plurality of bins, C. ejecting means disposed in each of said bins for ejecting sheets therefrom successively through said discharge openings, and D. control means for operating said sheet directing means and said ejecting means in a predetermined timed sequence to permit a predetermined number of sheets to enter each of said bins and to cause said ejecting means to eject said sheets from said bins successively when said predetermined number of sheets has been fed to said bins, whereby sheets from said supplemental source can be associated with sheets from said primary source at a location disposed downstream from said accumulating and directionally reorienting apparatus.

2. An apparatus as set forth in claim 1 wherein said sheet directing means comprises deflector means mounted for movement between alternate positions in which said deflector means directs sheets from said supplemental sheet feed path successively into said inlet openings of any one of said bins.

3. An apparatus as set forth in claim 2 wherein said means for directing sheets alternately into each of said bins comprises deflector means mounted adjacent said inlet openings of said bins, said deflector means being pivotally mounted to oscillate between first and second positions in which sheets are directed from said supplemental sheet feed path alternately into one or the other of said inlet openings.

4. An apparatus as set forth in claim 1 wherein said plurality of vertically stacked bins comprises a pair of upper and lower bins, and said means for directing sheets into said bins comprises means for directing said sheets alternately into said upper and lower each of said bins.

5. An apparatus as set forth in claim 3 wherein said ejecting means comprises means in each of said bins for ejecting sheets therefrom alternately.

6. A apparatus as set forth in claim 5 wherein said ejector means comprises pusher means movably mounted in each of said bins adjacent the side of said bins opposite said discharge openings, and drive means for moving said pusher means alternately toward and away from said discharge openings.

7. A apparatus as set forth in claim 6 wherein said drive means comprises means interconnecting said pusher means in each of said bins to operate said pusher means asynchronously so that one of said pusher means is moving in an ejecting direction while the other of said pusher means is moving in a retracting direction.

8. An apparatus as set forth in claim 7 wherein said pusher means for both of said bins are mounted in vertical alignment, and said drive means comprises a rack connected to each of said pusher means in vertically spaced relationship, a gear rotatably mounted between and engaged with both said racks, and means for driving said gear alternately in opposite directions so that rotation of said gear in one direction moves said racks and said pushers simultaneously in a first sequence of opposite directions, and rotation of said gear in the opposite direction moves said racks and said pushers simultaneously in a second sequence of opposite directions.

9. An apparatus as set forth in claim 3 wherein said pair of bins comprises A. a first substantially flat sheet forming the bottom of said lower bin, B. a second substantially flat sheet mounted in overlying relationship with said first sheet and forming the bottom of said upper bin, and defining with said first sheet said inlet and discharge openings into and out of said lower bin, and C. a third substantially flat sheet mounted in overlying relationship with said second sheet and forming a cover for said upper bin, and defining with said second sheet said inlet and discharge openings into and out of said upper bin.

10. An apparatus as set forth in claim 9 wherein each of said sheets are pivotally mounted about a common axis so that each sheet can be raised from a substantially horizontal position to a substantially vertical position to permit jams in either of said bins or in said primary sheet feed path beneath said lower bin to be cleared.

11. An apparatus as set forth in claim 10 wherein each of said bins is provided with stop means on the side thereof opposite said inlet openings to register incoming sheets.

12. An apparatus as set forth in claim 11 wherein each of said bins is provided with reverse stop means on the side thereof adjacent said inlet opening to prevent sheets entering said bins from bouncing back into said inlet openings.

13. An apparatus as set forth in claim 12 wherein both said stop means and said reverse stop means comprise upstanding flanges extending along the sides of said first and second sheets adjacent to and opposite said inlet openings.

14. An apparatus as set forth in claim 13 wherein said second and third sheets are provided with elongate slots which accommodate said upstanding flanges on said first and second sheets respectively when all said sheets are in said substantially horizontal position.

* * * * *